United States Patent [19]

Matherly et al.

[11] Patent Number: 4,542,873

[45] Date of Patent: Sep. 24, 1985

[54] BOW HOLDER

[76] Inventors: James F. Matherly, Rte. 2; Benny S. Southard, Rte. 1, Box 177, both of Summerfield, N.C. 27358

[21] Appl. No.: 499,834

[22] Filed: Jun. 1, 1983

[51] Int. Cl.[4] ..... E04G 5/06

[52] U.S. Cl. ..... 248/218.4; 124/23 R

[58] Field of Search ..... 124/1, 24 R, 23 R, 80, 124/86; 248/200, 218.4, 126, 176, 122, 309 R; 211/68, 69.1, 64, 89; 40/530

[56] References Cited

U.S. PATENT DOCUMENTS

| | | | |
|---|---|---|---|
| 2,275,870 | 3/1942 | Sheldon | 124/23 R |
| 3,256,872 | 6/1966 | Koser | 124/23 R |
| 4,331,311 | 5/1982 | Russell | 124/23 R X |
| 4,360,179 | 11/1982 | Roberts | 124/23 R X |

OTHER PUBLICATIONS

Potawatomi Bow Holder—Archery Magazine, Jun. 1978, p. 16.

*Primary Examiner*—Richard J. Apley
*Assistant Examiner*—William R. Browne
*Attorney, Agent, or Firm*—Griffin, Branigan & Butler

[57] ABSTRACT

A sportsman's or hunter's bow holder in which an elongated bow-supporting stanchion has an elongated slot for vertically adjusting the angle and elevation of the stanchion relative to a supporting bracket. The stanchion is provided with a bow-engaging fixed member in spaced relation to a resilient member for engaging and urging the bow frame against the fixed member for retaining the bow and having it readily accessible for use.

7 Claims, 5 Drawing Figures

BOW HOLDER

BACKGROUND AND OBJECTIVES OF THE INVENTION

This invention generally relates to a device for supporting a sportsman bow while the hunter is positioned on a hunting stand with the bow being readily accessible for immediate use.

Serious hunters and sportsmen who use bows and arrows for hunting as well as target practice are disinclined to leave their bows unattended in an unsupported position whether for storage or accessibility in order to reduce damage to the bow. The serious bow hunter usually spends long hours on a hunting stand awaiting game and prefers not to hold the bow but to have it readily accessible when required. Some hunters may use a peg or nail secured to a tree and simply hang the bow in the best position that may be provided.

The present invention has as an objective the provision of a bow holder for supporting a bow in an upright position that will firmly retain the bow at a ready location and accessible to the hunter.

Another objective of the present invention is to provide a compact and lightweight bow holder which will firmly retain the bow in a vertical position while permitting the bow to be quickly, quietly and automatically released when it is to be used.

Still another objective of the present invention is to provide a bow holder that may be supported at the arm level of the hunter ready for immediate use and one which may be easily returned to the holder with minimum effort and movement.

A further objective of the present invention is to provide a bow holder that may be readily installed on a hunting stand and positioned at the proper elevation and angle for supporting a bow and one which will withstand repeated use and resist wear and the elements.

Other objects and many of the attendant advantages of the present bow holder will become more readily apparent to those skilled in using bows for hunting and target practice upon consideration of the detailed description and claims in which equivalents are contemplated along with variations.

SUMMARY OF THE INVENTION

This invention relates to a holder for retaining a sportsman's bow in which a bow-supporting stanchion is releasably and adjustably secured to a stanchion-supporting bracket with the bow-supporting stanchion having an elongated or longitudinally-extending slot for vertical and angular adjustments. The bow is releasably retained on the bow-supporting stanchion through a fixed bow-engaging member that projects from the stanchion and by means of a resilient stabilizing means that is supported on the stanchion in spaced relation to the fixed bow-engaging member for urging and supporting the bow against the bow-engaging member. The stanchion supporting bracket is provided with means for releasably securing the stanchion at the desired inclination and elevation and is also provided with a member for limiting the angular displacement of the stanchion in one mode of displacement.

DETAILED DESCRIPTION OF THE PREFERRED EMBODIMENT

Figure 1:
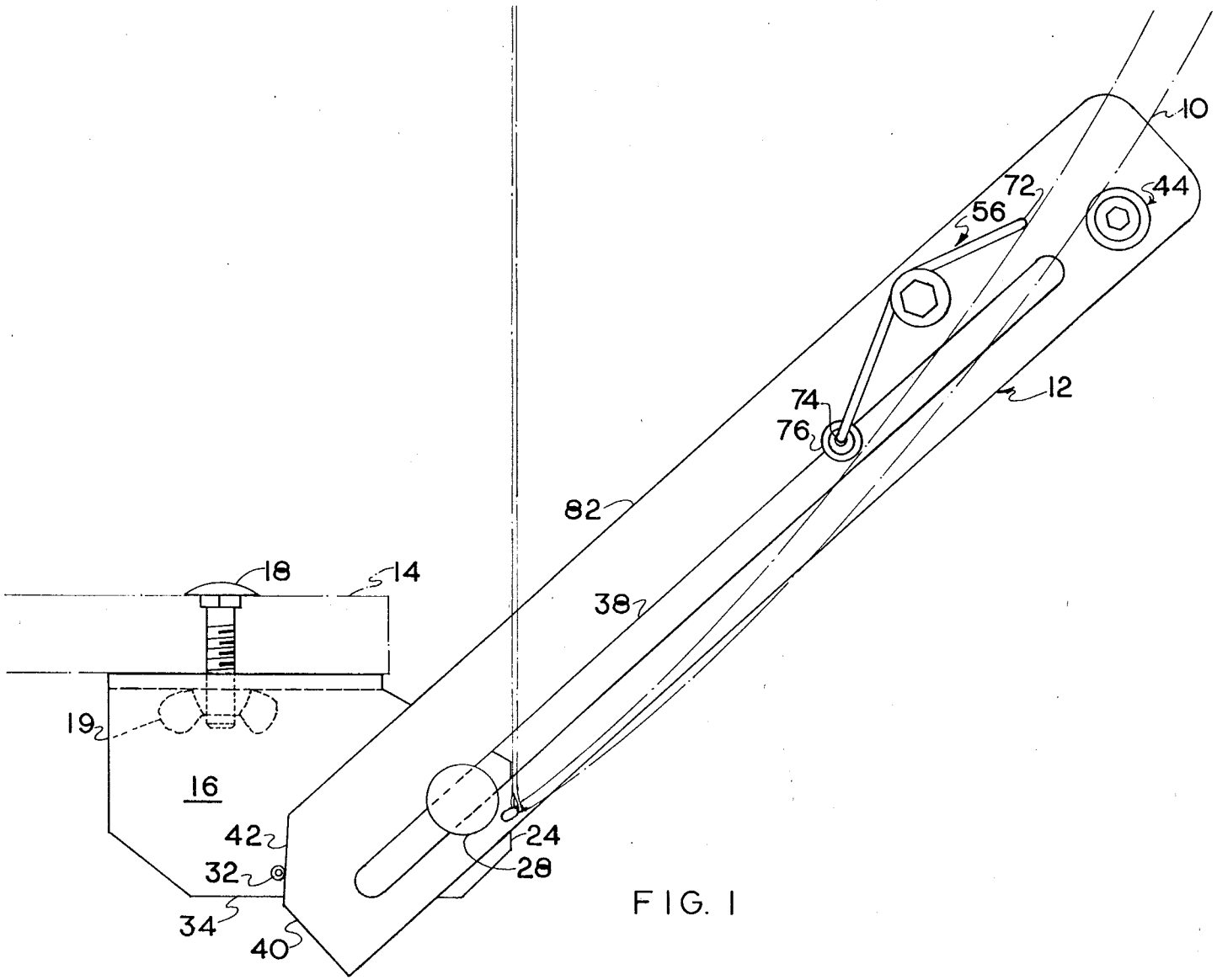
FIG. 1 is a side elevational view of a mounted bow holder supporting a bow which is partially shown.
Figure 2:
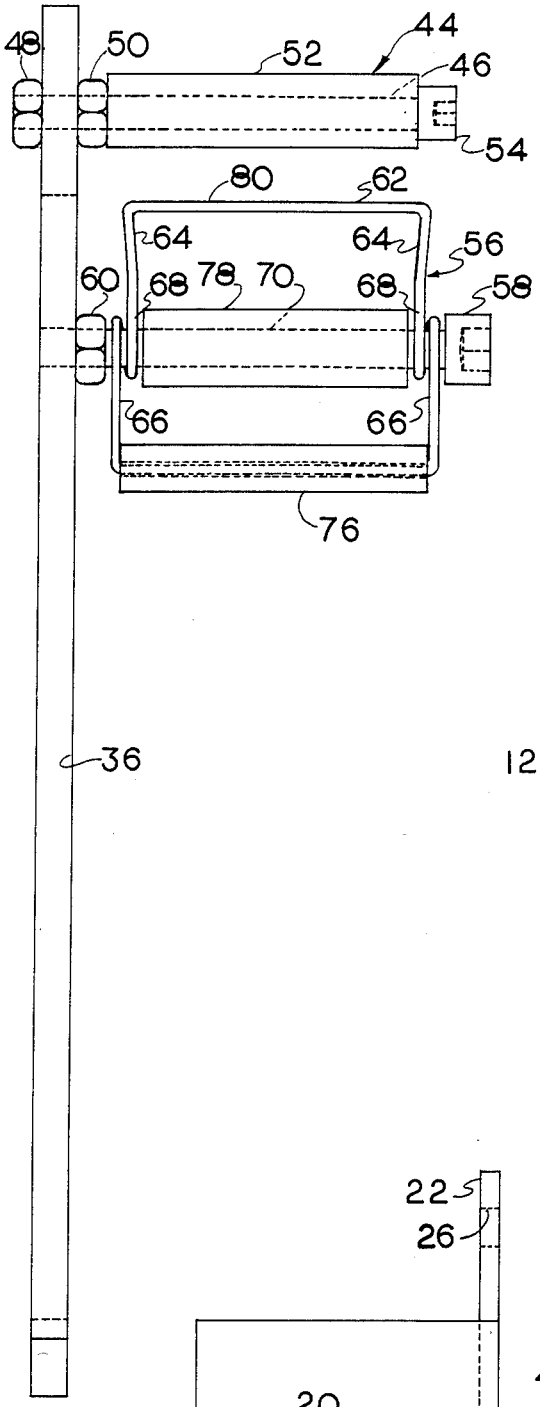
FIG. 2 is a top plan view of the bow holder of FIG. 1 omitting the stanchion supporting bracket.

Referring to the drawing and particularly to FIG. 1, there is illustrated the lower portion only of a hunter's bow 10, shown in outline form, supported in an upright position by a bow holder 12 that is retained at the desired elevation and angle relative to the platform or seat 14, only a portion of which is shown in outline form, to which a stanchion supporting bracket 16 is securely fastened by means of the carriage bolt 18 and wing nut 19.

Bracket 16 has a flat projecting flange portion 20 that extends at a right angle to the depending web 22 that projects forwardly, as shown in FIG. 1, to form a ledge 24 through which a hole 26 passes to receive the carriage bolt 28 and nut (not shown). A hole 30 passes through the flange portion 20 to receive the carriage bolt 18 for retaining the bracket 16 to a hunter's platform or seat 14 which may be secured suitably to a tree, pickup truck or other location for mounting. A stanchion limiting stop 32 in the form of a dowel pin is securely retained adjacent to the lower periphery of the bracket perimeter 34.

Bow holder 12 is preferably a flat elongated steel strip that forms a bow-supporting stanchion 36 in which a longitudinal positioning slot 38 is milled to provide for vertical displacement and adjustment relative to the bracket 16. The carriage bolt 28 which passes through slot 38 has its mushroom-shaped head overlapping the width of slot 38 with the square extension (not shown) under the head of bolt 28 being slidably retained within slot 38. The carriage bolt 28 has a wing nut (not shown) threadably retained thereon for securing the stanchion 36 in position whether by friction or other means to be described hereafter. The stanchion end section 40 is provided with an inclined camming surface 42 that cooperatively engages with the stanchion limiting stop 32 to retain the stanchion in the position as shown in FIG. 1.

A fixed bow-engaging member 44 is made up from an elongated Allen head bolt 46 which is securely fastened to stanchion 36 through a hole (not shown) and retained by means of the hexagonal nuts 48 and 50 on opposite sides of the stanchion to lock the threaded bolt 46 in position. A resilient sleeve 52 of durable rubber or plastic material encircles the bolt 46 between the head 54 and nut 50 to prevent scarring of the bow frame which contacts the sleeve 52.

Figure 3:
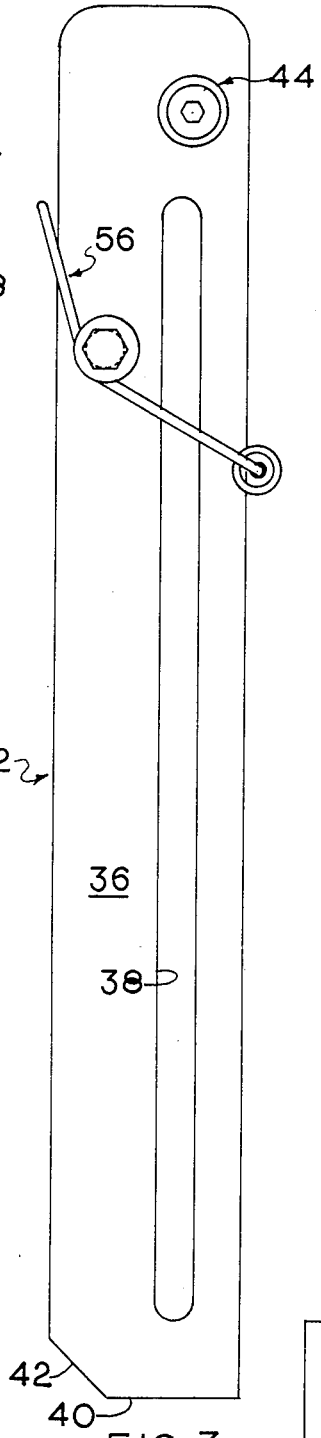
FIG. 3 is a right side view of FIG. 2.
Figure 4:
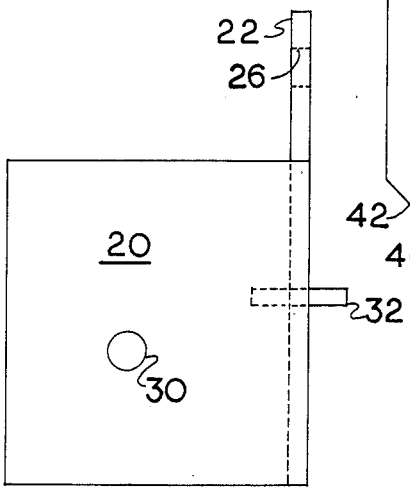
FIG. 4 is a top plan view of the stanchion supporting bracket.
Figure 5:
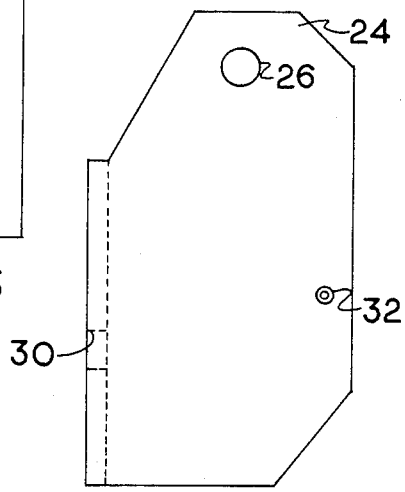
FIG. 5 is a side elevational view of FIG. 4 rotated 180° counterclockwise

A resilient stabilizing means 56 in the form of a butterfly spring 62 is retained on the elongated Allen head bolt 58 which is threadably retained in the stanchion 36 in spaced relation to the fixed bow-engaging member 44 and locked in position by the hexagonal nut 60. The butterfly spring 62 is pivotally retained on the shank of the bolt 58 and is provided with a first wire section 64 and a second wire section 66 integrally connected by the medial helical section 68 which encircles and is pivotally supported on shank 70 of the bolt 58. The medial section of the wire portion provides the spring action for each of he first and second sections of the butterfly spring 62 with both sides being substantially the same. The resilient stabilizing means 56 is illustrated in FIG. 1 in the active position for retaining the bow frame in position by resiliently urging the bow frame against the fixed bow-engaging member 44 through the action of the butterfly spring in which the contacting portions 72 of the first section 64 engages the bow frame while the second section 74 is extended resiliently to another portion of the bow frame and is encircled by the resilient sleeve 76. In the position shown in FIG. 1, the resilient stabilizing means 56 is extended through the resiliency of the spring sections urging the bow frame against the fixed bow-engaging member 44. The resilient stabilizing means 56 shown in FIG. 3 is in the inoperative relaxed condition.

In FIG. 1, the bow-supporting stanchion 36 is positioned so that the camming surface 42 engages the limiting stop 32 and the wing nut on carriage bolt 28 will be tightened to secure stanchion 36 in the position shown. The bow 10 may be positioned readily below first and second sections 64 and 66 of the resilient stabilizing means 56 by simply sliding the bow into position and it will be retained in the vertical orientaion as illustrated without further support. Removal of the bow is achieved simply by removing the bow laterally from the holder against the spring action of the resilient means 56.

A resilient tubular sleeve member 78 may be placed over the shank 70 of the bolt 58 and an additional sleeve similar to sleeve 76 may be positioned over the rectilinear section 80 of the first section 64 of the butterfly spring 62.

In the event other elevations or angularity is required for positioning the bow holder 12, the stanchion 36 may be elevated and the limit stop 32 may be positioned against the rectilinear edge 82 of the stanchion and the wing nut on the carriage bolt 28 securely fastened for retaining the stanchion in position for a variety of locations along the elongated slot 38 depending upon the bow frame and the platform or seat 14 to which the bracket 16 may be secured in order to make the bow readily accessible from a supporting position.

The metal components of the bow holder are suitably treated to resist corrosion. The various components may be readily disassembled for compact packaging and for easy access and assembly by the hunter or sportsman.

We claim:

1. A holder for retaining a hunting bow comprising; a bow-supporting stanchion, a fixed bow-retaining member projecting from said stanchion, resilient bow stabilizing means supported on said stanchion spaced from said bow-engaging member for urging and supporting a bow against said bow-retaining member, and a stanchion supporting bracket for releasably retaining said stanchion to a support structure.

2. A holder for retaining a hunting bow as claimed in claim 1, said resilient stabilizing means including a butterfly spring centrally pivoted having first and second extending sections and a medial portion, a resilient stabilizing means supporting pivot member secured to said stanchion for pivotally supporting said spring at said medial portion, said first extending section engaging one part of a bow and second extending section engaging another part of a bow in spaced relation to each other and to said fixed bow-retaining member.

3. A holder for retaining a hunting bow as claimed in claim 2, at least one of said extending spring sections having a cylindrical resilient sleeve thereon for engaging a bow.

4. A holder for retaining a hunting bow as claimed in claim 1, stanchion fastening means on said stanchion supporting bracket for releasably securing the stanchion to the bracket, said stanchion haing a longitudinal slot for positioning the stanchion on said stanchion fastening means at a selected position relative to said stanchion supporting bracket.

5. A holder for retaining a hunting bow as claimed in claim 1, said stanchion-supporting bracket having a stanchion limiting stop, stanchion fastening means for releasably retaining said stanchion to said supporting bracket, said stanchion having a longitudinal slot for positioning the stanchion on said stanchion fastening means at a selected postion relative to said stanchion supporting bracket and having an inclined camming end for cooperatively engaging said stanchion limiting stop for positioning said stanchion at a desired inclination for supporting a bow.

6. A holder for retaining a hunting bow as claimed in claim 1, said stanchion having a longitudianl slot for positioning said stanchion at a selected position relative to said stanchion-supporting bracket, and stanchion fastening means on said bracket for releasably locking said stanchion to said bracket at a desired elevation and angle through said longitudinal slot.

7. A holder for retaining a hunting bow as claimed in claim 1, said fixed bow-retaining member having an elongated shaft, and a cylindrical resilient sleeve mounted on said shaft.

* * * * *